US006659810B2

(12) United States Patent
Okabe et al.

(10) Patent No.: US 6,659,810 B2
(45) Date of Patent: Dec. 9, 2003

(54) METHOD OF ASSEMBLING MULTI-POLE CONNECTOR AND MULTI-POLE CONNECTOR

(75) Inventors: Toshiaki Okabe, Shizuoka (JP); Tetsuya Yamashita, Shizuoka (JP); Kazuhiro Kawachi, Aichi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/159,983

(22) Filed: Jun. 3, 2002

(65) Prior Publication Data

US 2002/0182941 A1 Dec. 5, 2002

(30) Foreign Application Priority Data

Jun. 4, 2001 (JP) ..... P2001-168326

(51) Int. Cl.[7] ..... H01R 13/502
(52) U.S. Cl. ..... 439/701; 439/364
(58) Field of Search ..... 439/350–358, 439/362, 364, 374, 594, 701, 717, 598, 599, 638, 686, 695, 639, 640, 540.1

(56) References Cited

U.S. PATENT DOCUMENTS 5,413,507 A * 5/1995 Sawada ..... 439/701
5,454,733 A * 10/1995 Watanabe et al. ..... 439/540.1
5,545,053 A * 8/1996 Ishii et al. ..... 439/701 X
5,599,200 A * 2/1997 Yagi et al. ..... 439/381

FOREIGN PATENT DOCUMENTS

JP 62-145671 6/1987

* cited by examiner

*Primary Examiner*—Lynn Field
*Assistant Examiner*—Son V. Nguyen
(74) *Attorney, Agent, or Firm*—Sughrue Mion, PLLC

(57) ABSTRACT

In a multi-pole connector formed by combining a plurality of connector housings together, a bolt and a bolt receiving tube are provided at first connector housing, and a frame portion is formed on the second connector housing. The connector housings are combined together, with the frame portion and the bolt receiving tube superimposed together coaxially with each other, so that a bolt guide, formed on a mating multi-pole connector for connection to the multi-pole connector, can be inserted into the frame portion and the bolt receiving tube.

8 Claims, 10 Drawing Sheets

METHOD OF ASSEMBLING MULTI-POLE CONNECTOR AND MULTI-POLE CONNECTOR

BACKGROUND OF THE INVENTION

The invention relates to a multi-pole connector connected to a mating multi-pole connector by a bolt-and-nut construction to provide a connector, and more particularly to a method of assembling the multi-pole connector, formed by combining a plurality of connector housings together, and to such a multi-pole connector.

One known conventional multi-pole connector is disclosed in JP-A-62-145671. Referring to FIG. 9, for the purpose of enhancing the productivity, the multi-pole connector 101 is formed by combining a plurality of (for example, three) connector housings 103A, 103B and 103C together.

A nut 105 is formed at a central portion of the connector housing 103A, and fitting openings 107 and 109 for respectively receiving the connector housings 103B and 103C are formed in upper and lower portions of the connector housing 103A, respectively. Elastic retaining arms 111 are formed respectively on side walls of each of the fitting openings 107 and 109, and can be lockingly engaged respectively in retaining grooves 113 formed respectively in side walls of the corresponding connector housing 103B, 103C.

The connector housing 103B and the connector housing 103C are slidingly inserted respectively into the upper and lower portions of the connector housing 103A, and therefore are combined with the connector housing 103A, and then comb-like rear holders 115 and 117 are inserted through the side surfaces in order to prevent the rearward withdrawal of these connector housings 103B and 103C. Thus, the multi-pole connector 101 is assembled.

The thus assembled multi-pole connector 101 is fittingly connected to a mating multi-pole connector 123 (shown in FIG. 11) by the nut 105, formed on the multi-pole connector 101, and a bolt 121, formed on the mating multi-pole connector, to form a connector.

In the above conventional construction, however, when determining the pitches of the connector housings 103A, 103B and 103C, the nut 105 is used as a reference. Therefore, when determining the pitch, for example, of the connector housing 103B, an error a in the pitch A of the connector housing 103A from the nut 105 to the mounting position of the connector housing B and an error b in the pitch B of the connector housing 103B are added together in an accumulated manner as shown in FIG. 12, and the sum of these errors become an error in the pitch of the connector housing 103B. Therefore, there is encountered a problem that an error in the connector housing 103B, which is the combining portion, increases. Similarly, an error in the connector housing 103A and an error in the connector housing 103B are added together in an accumulated manner, so that the total error for the connector housing 103C increases.

SUMMARY OF THE INVENTION

With the above problem of the conventional construction in view, it is an object of this invention to provide a method of assembling a multi-pole connector, as well as a multi-pole connector, in which in order that an error in the multi-pole connector, formed by combining a plurality of connector housings together, can be reduced, the alignment of the connector housings can be effected easily and accurately.

In order to solve the aforesaid object, the invention is characterized by having the following arrangement.

(1) A multi-pole connector comprising:

a first connector housing including a bolt and a bolt receiving tube; and a second connector housing including a frame portion, wherein the first and second connector housings are connected together so as to coaxially superimpose the frame portion on the bolt receiving tube so that a bolt guide formed on a mating multi-pole connector for connection to the multi-pole connector can be inserted into the frame portion and the bolt receiving tube.

(2) The multi-pole connector according to (1), wherein the first connector housing and the second connector housing have a connecting mechanism for connecting the first connector housing to the second connector housing before the bolt guide is inserted into the frame portion and the bolt receiving tube.

(3) The multi-pole connector according to (1), wherein a plurality of the second connector housings are connected to the first connector housing, and each of the frame portions of the plurality of the second connector housings is coaxially superimposed on the bolt receiving tube.

(4) A method of assembling a multi-pole connector comprising a first connector housing including a bolt and a bolt receiving tube, and a second connector housing including a frame portion, the method comprising the steps of:

connecting the first connector housing to the second connector housing so as to coaxially superimpose the frame portion on the bolt receiving tube; and inserting a bolt guide formed on a mating multi-pole connector for connection to the multi-pole connector into the frame portion and the bolt receiving tube.

DETAILED DESCRIPTION OF PREFERRED EMBODIMENTS

A preferred embodiment of the present invention will now be described in detail with reference to the drawings. FIGS.

1 to 3 show a multi-pole connector 1 of the present invention. The multi-pole connector 1 comprises a first connector housing 3, and a second connector housing 5 connected to and combined with the first connector housing 3.

Figure 4:
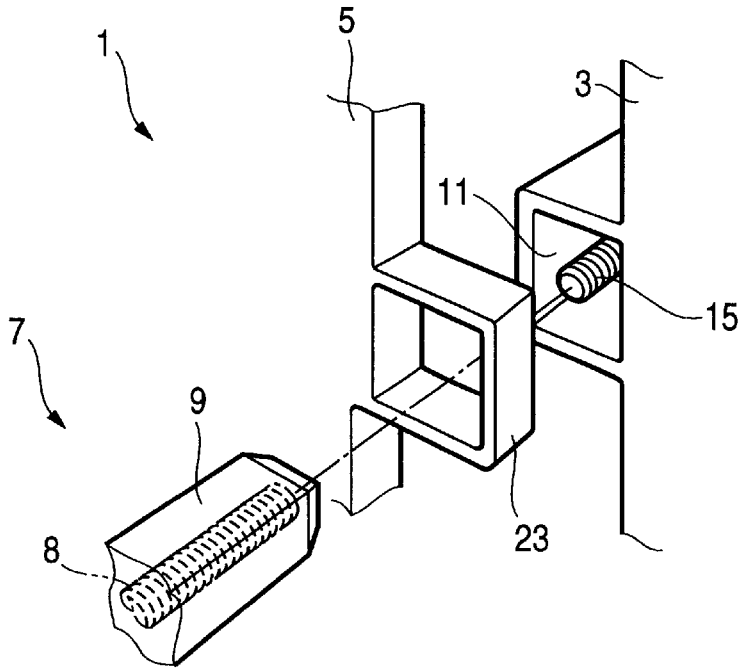
FIG. 4 is a perspective view showing a bolt guide of a mating multi-pole connector and an important portion of the multi-pole connector.

Referring to FIG. 4, a bolt guide 9 is formed on a mating multi-pole connector 7 (details are omitted) which is to be connected to the multi-pole connector 1, and a nut 8 is formed in the bolt guide 9. A bolt receiving tube 11 is formed at the first connector housing 3 of the multi-pole connector 1, and a bolt 15 is provided within the bolt receiving tube 11 at a central portion thereof, and this bolt 15 can be threaded into the nut 8 in the bolt guide 9. The bolt receiving tube 11 has generally the same cross-sectional shape as the cross-sectional shape (for example, a square cross-sectional shape) of the bolt guide 9.

Figure 1:
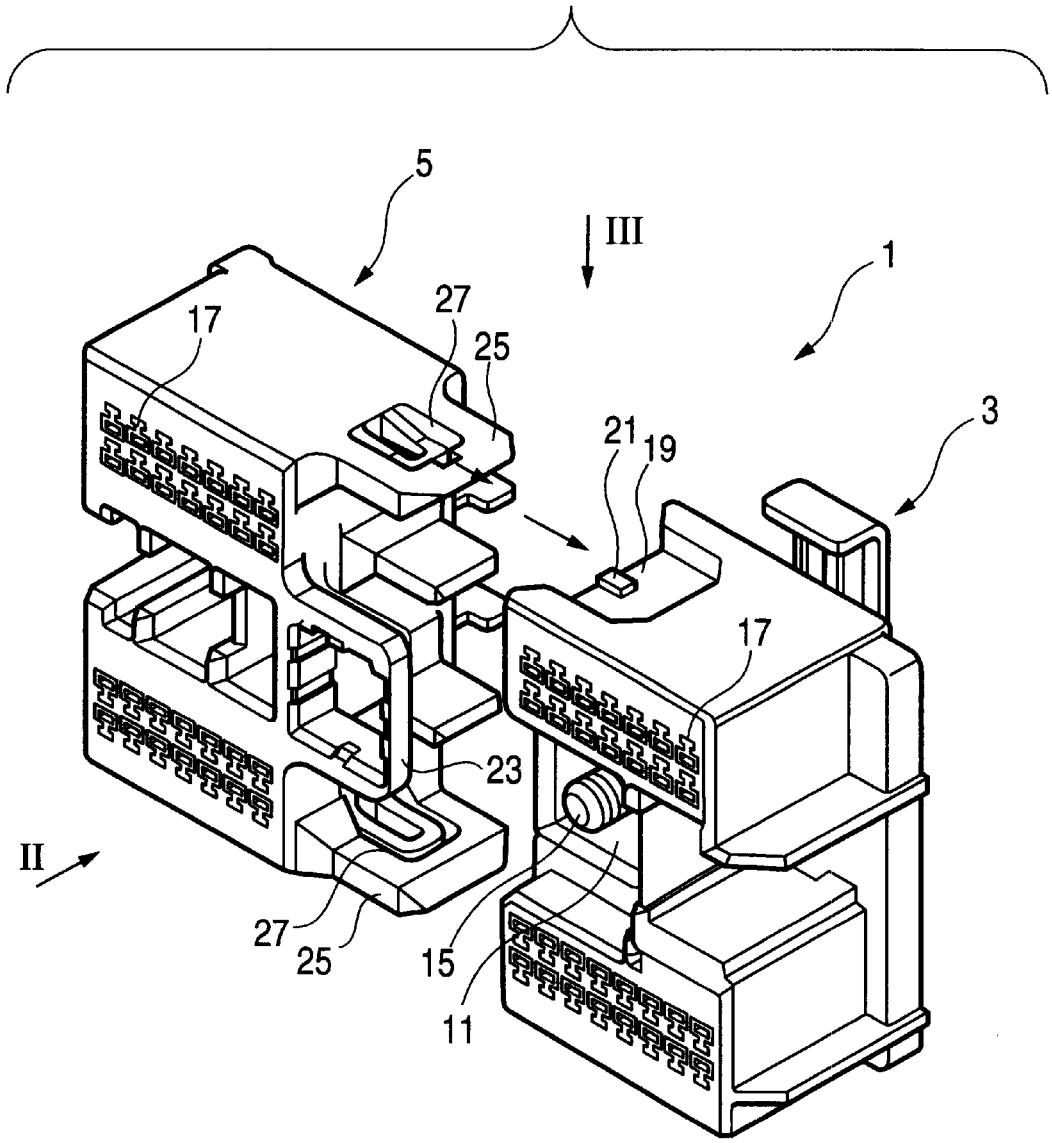
FIG. 1 is a perspective view of a multi-pole connector of the present invention.
Figure 2:
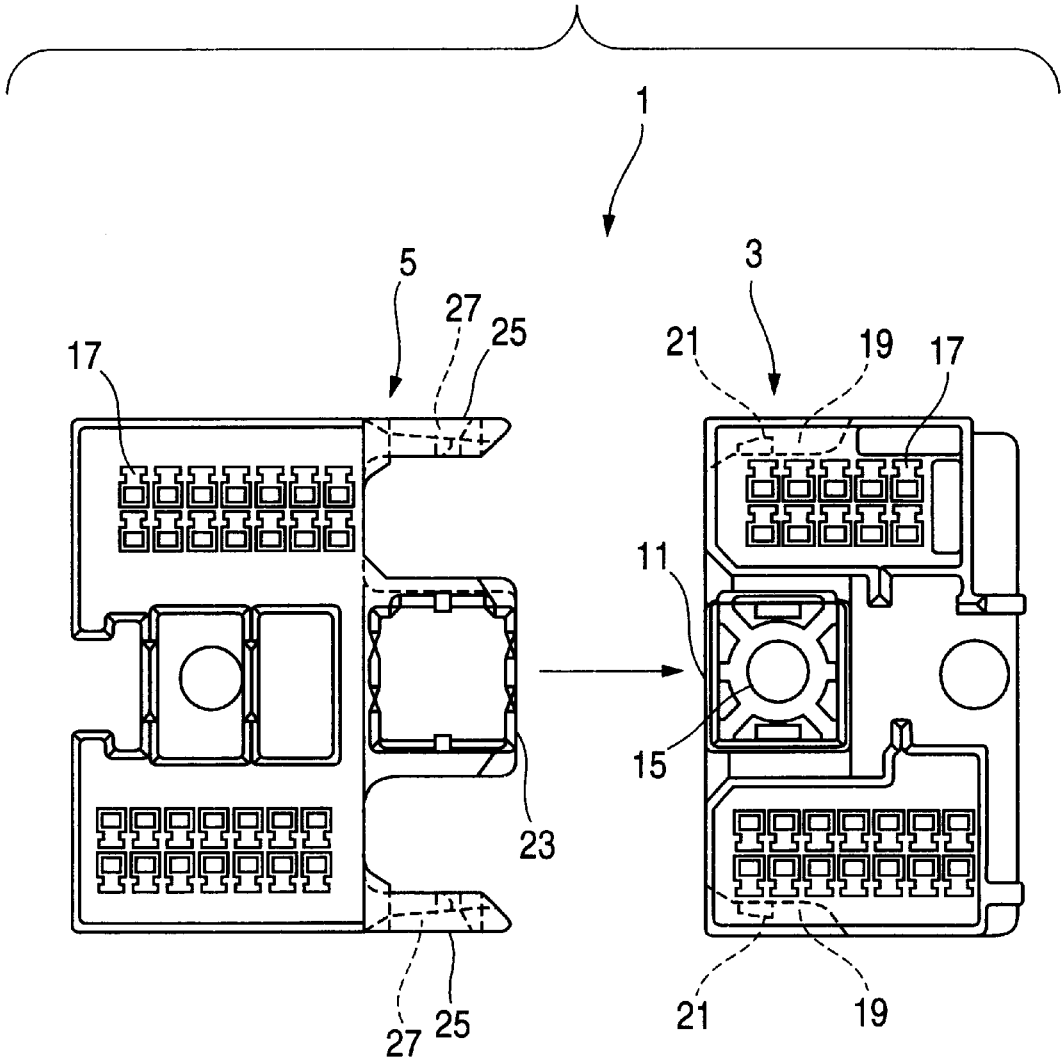
FIG. 2 is a front-elevational view as seen from a direction II of FIG. 1.
Figure 3:
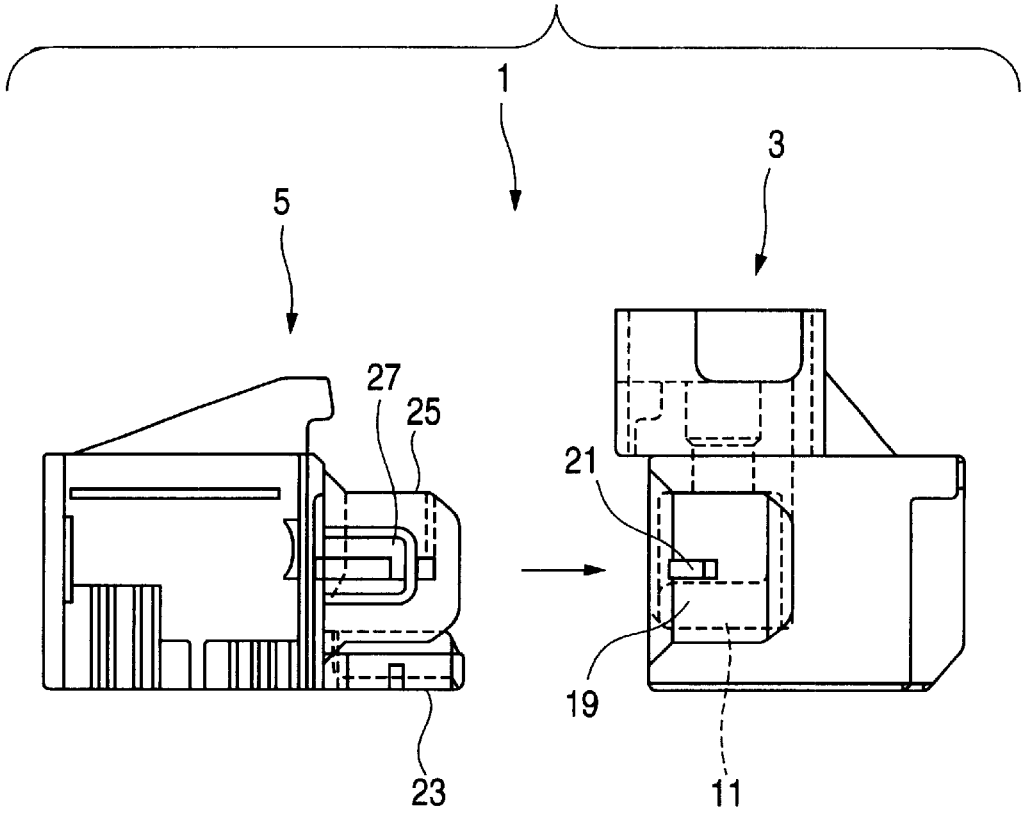
FIG. 3 is a plan view as seen from a direction III of FIG. 1.

Many cavities 17 are provided in those portions of the first connector housing 3 and disposed respectively above and below the bolt receiving tube 11. Fitting recess portions 19, serving as a connecting mechanism, are provided at upper and lower surfaces of the first connector housing 3, respectively. An engagement projection 21 for being engaged with the second connector housing 5 at the time of the combining operation is formed at a central portion of a front portion (left-hand portion in FIG. 1) of each fitting recess portion 19.

A frame portion 23 is formed on a central portion of a right side surface (see FIG. 1) of the second connector housing 5, and projects toward the first connector housing 3. At the time of the combining operation, the frame portion 23 is superimposed on the bolt receiving tube 11 in coaxial relation thereto. The inner surface of the frame portion 23 is generally identical in shape to the outer surface of the bolt guide 9 and the inner surface of the bolt receiving tube 11. Mounting arms 25, so shaped as to fit respectively in the fitting recess portions 19 formed in the first connector housing 3, are formed respectively on the upper and lower sides of the second connector housing 5, and project in the same direction as the direction of projecting of the frame portion 23. Each of the mounting arms 25 has an engagement portion 27 for engagement with the engagement projection 21 provided at the corresponding fitting recess portion 19.

Then, the bolt guide 9 of the mating multi-pole connector 7 is passed through the frame portion 23 (superimposed on the bolt receiving tube 11), and is inserted into the bolt receiving tube 11 of the multi-pole connector 1, and the frame portion 23 and the bolt receiving tube 11 are aligned with each other (that is, positioned relative to each other) by inserting this bolt guide 9, so that the first connector housing 3 and the second connector housing 5 are combined together. At the same time, the bolt 15 of the multi-pole connector 1 is threaded into the nut 8, formed in the bolt guide 9 of the mating multi-pole connector 7, so that the multi-pole connector 1 and the mating multi-pole connector 7 are connected together.

Figure 5:
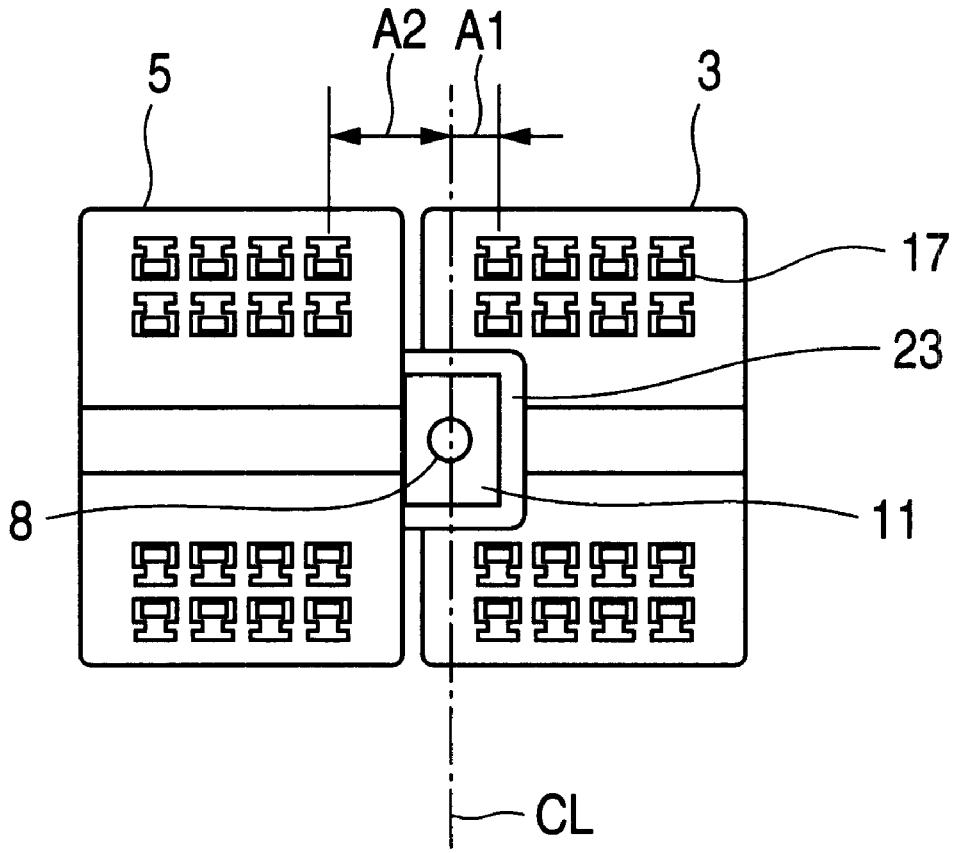
FIG. 5 is a view explanatory of a pitch determined using a nut as a reference.

As described above, when connecting the multi-pole connector 1 and the mating multi-pole connector 7 together, the first connector housing 3 and the second connector housing 5 of the multi-pole connector 1 are brought into alignment with each other by the bolt guide 9 of the mating multi-pole connector 7, and therefore dimensions A1 and A2 from the center CL of the nut 8 can be obtained as shown in FIG. 5. Therefore, tolerances of the cavities 17 are equal to tolerances of the dimensions A1 and A2, and an accumulated error is prevented from developing also in the second connector housing 5.

Figure 6:
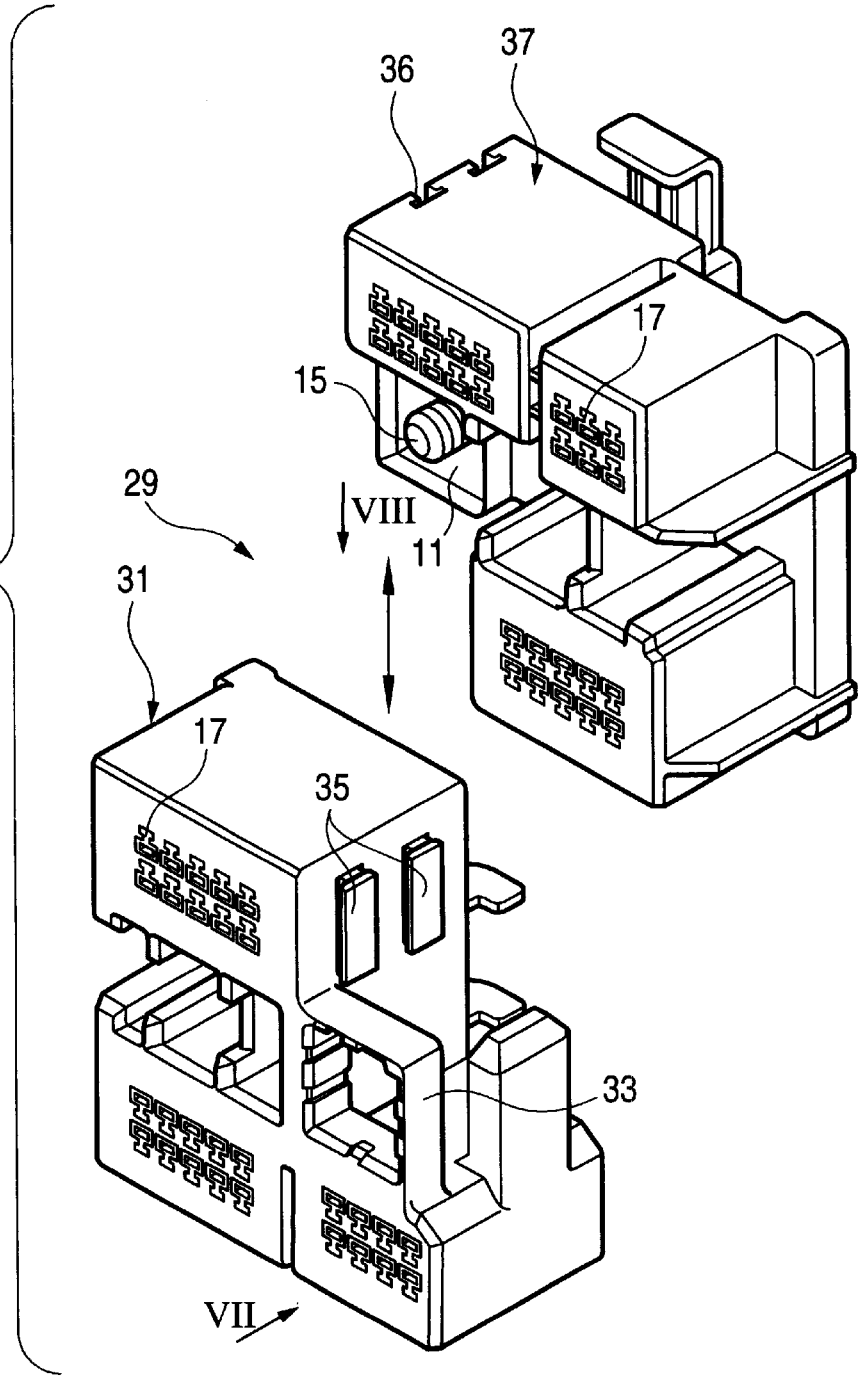
FIG. 6 is a perspective view of another embodiment of a multi-pole connector of the invention.
Figure 7:
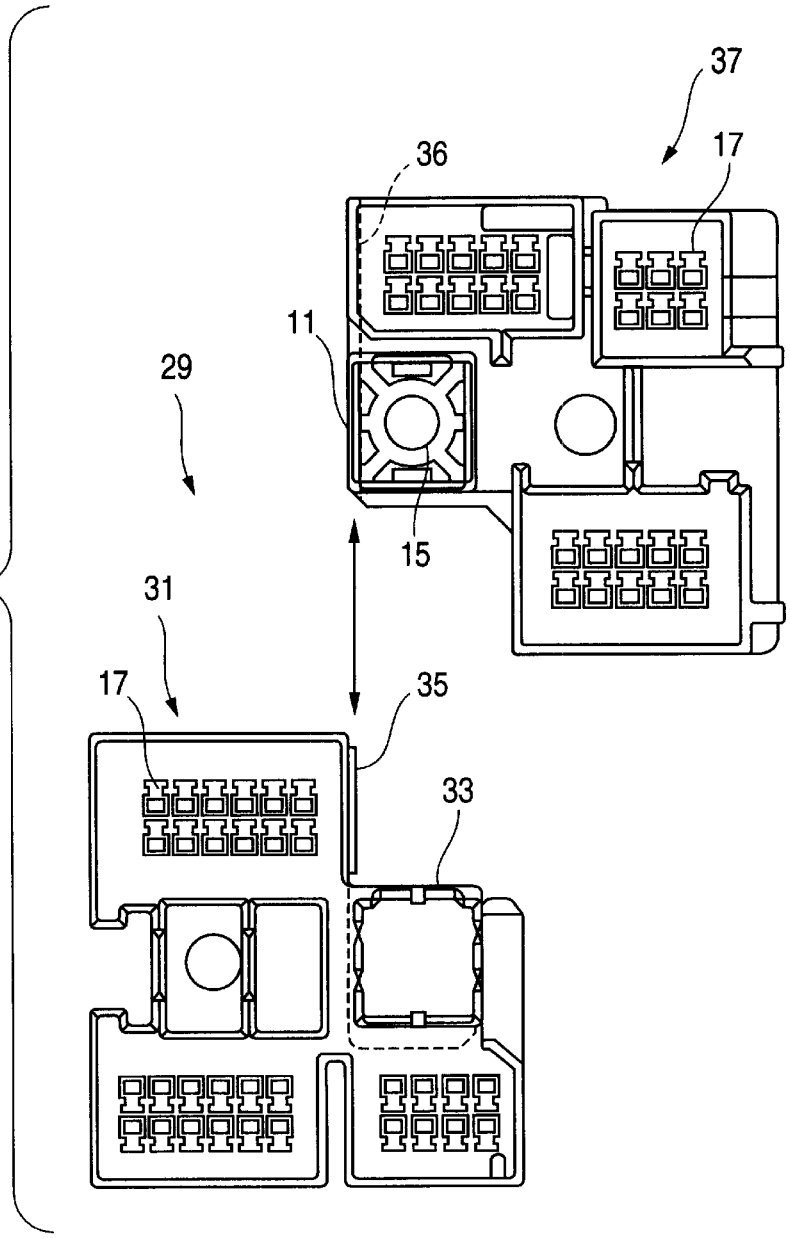
FIG. 7 is a front-elevational view as seen from a direction VII of FIG. 6.
Figure 8:
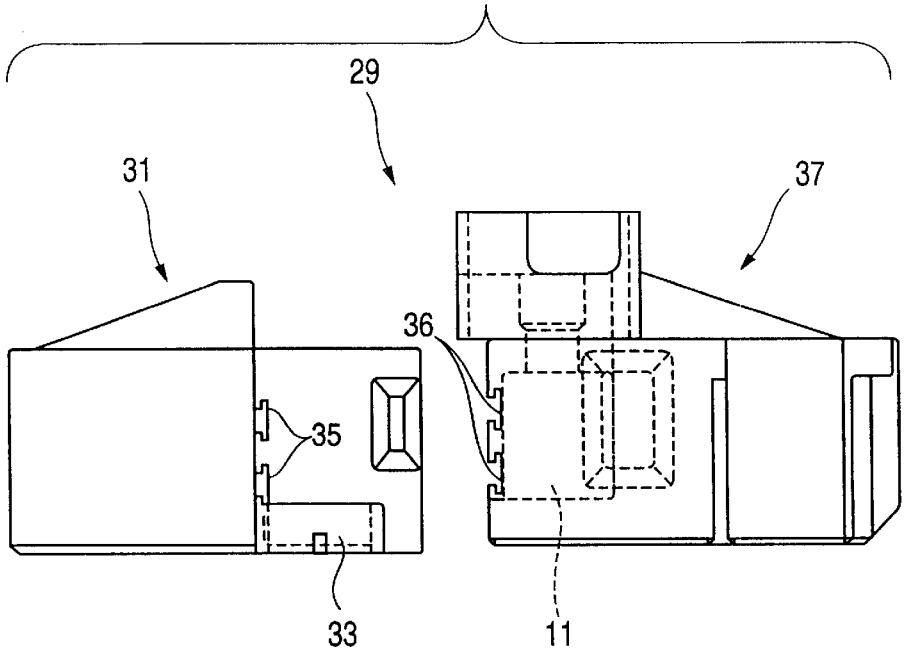
FIG. 8 is a plan view as seen from a direction VIII of FIG. 6.
Figure 9:
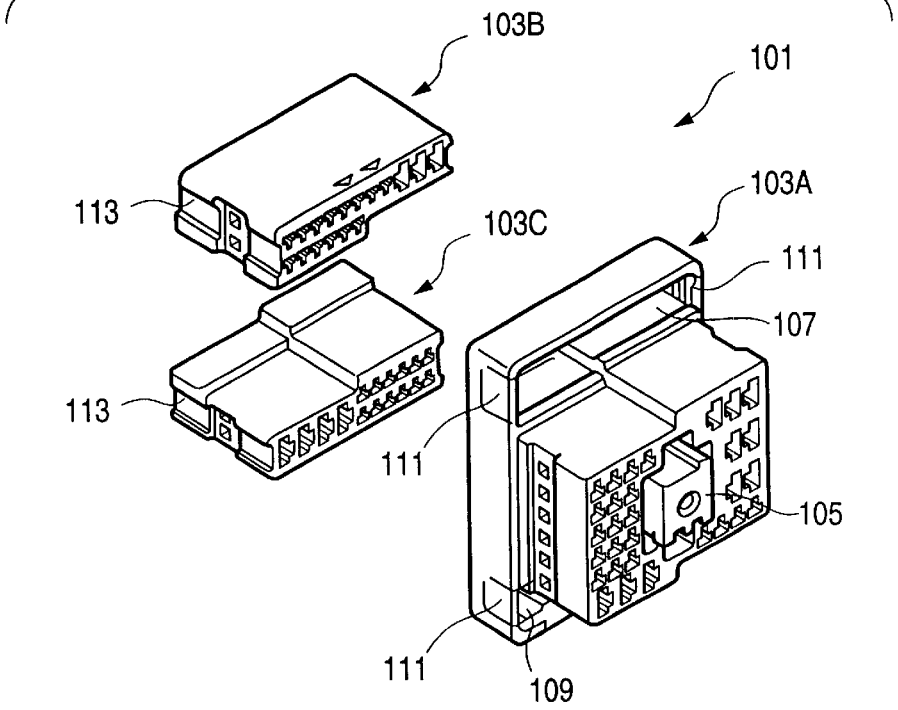
PRIOR ART FIG.9
FIG. 9 is an exploded, perspective view of a conventional multi-pole connector.
Figure 10:
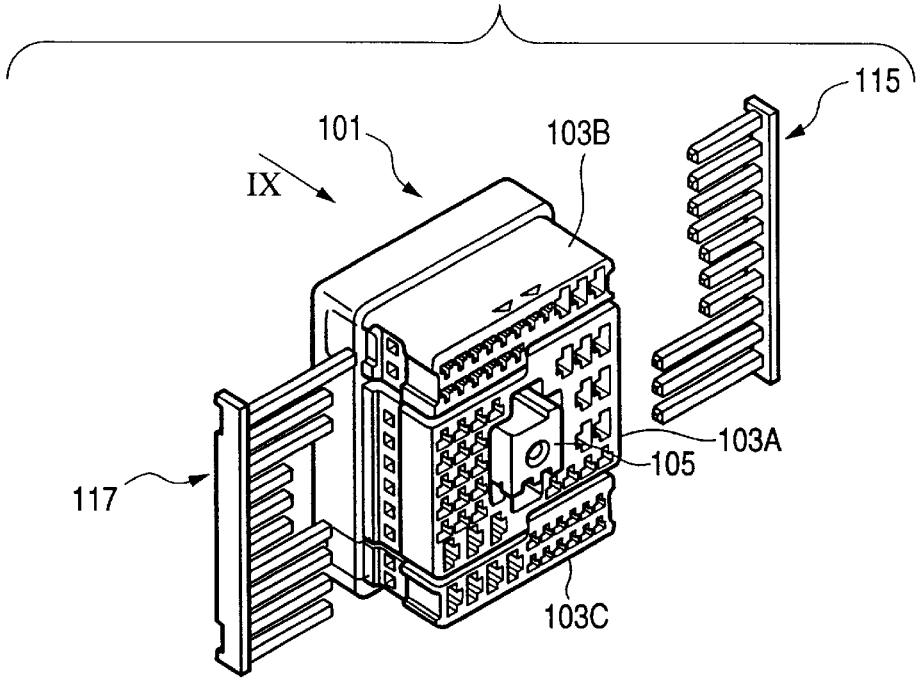
PRIOR ART FIG. 10
FIG. 10 is a perspective view of the conventional multi-pole connector in its assembled condition.
Figure 11:
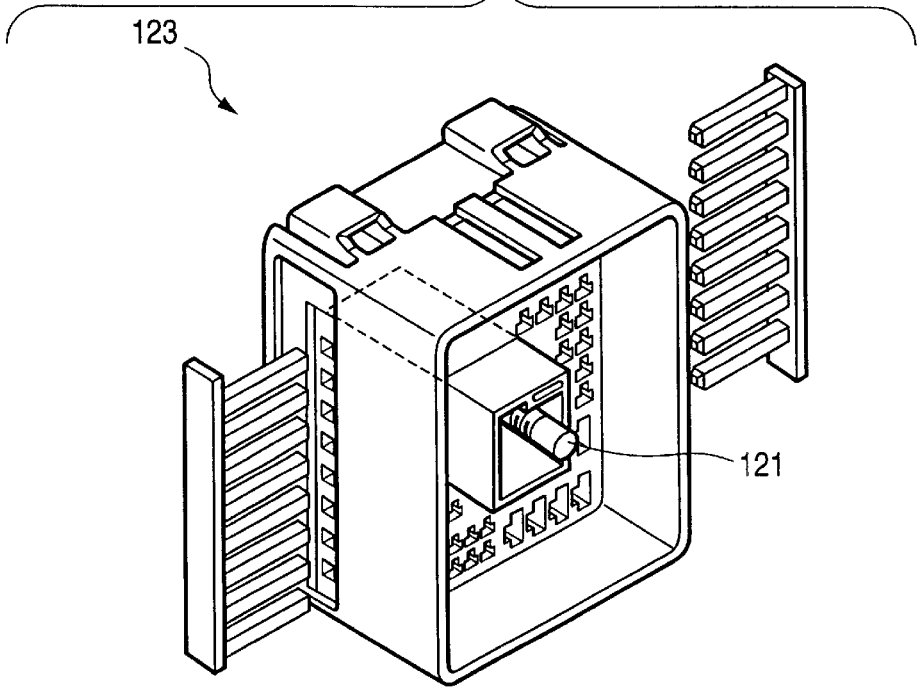
PRIOR ART FIG. 11
FIG. 11 is a perspective view of a conventional mating multi-pole connector.
Figure 12:
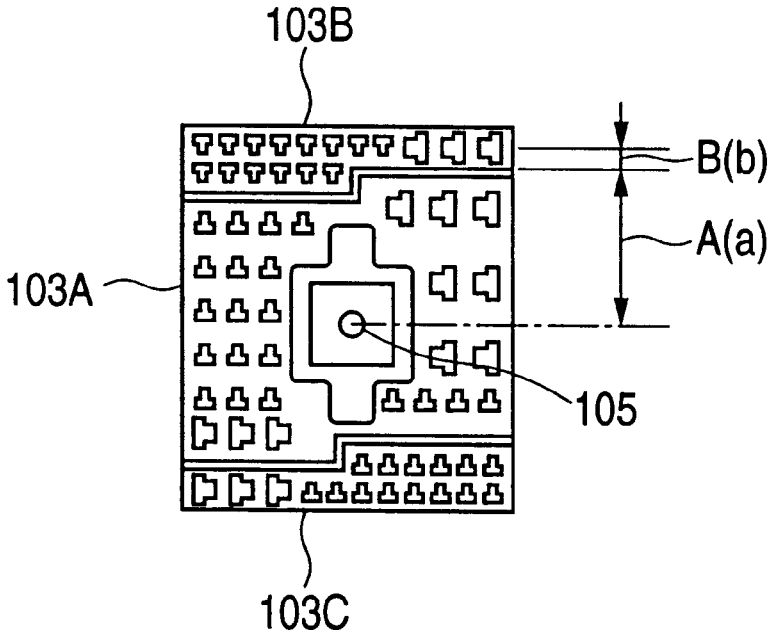
PRIOR ART FIG. 12
FIG. 12 is a front-elevational view as seen from a direction IX of FIG. 10, explaining pitches.

The present invention is not limited to the above embodiment, and other form of the invention can be carried out by suitable modifications. More specifically, in the above embodiment of the invention, although the frame portion 23, which is superimposed on the bolt receiving tube 11 of the first connector housing 3 in coaxial relation thereto, is formed on and projects from the second connector housing 5, a frame portion 33 may be formed at a portion of the second connector housing 31 as in a multi-pole connector 29 shown in FIGS. 6 to 8.

Guide rails 35 for connection to first connector housing 37 are formed on a side surface of the second connector housing 31 disposed above the frame portion 33, and rail grooves 36 are formed in a side surface of the first connector housing 37 disposed above a bolt receiving chamber. The guide rails 35 are slidably connected respectively to the rail grooves 36 for upward and downward movement as indicated by an arrow, and by doing so, the first connector housing 37 and the second connector housing 31 are connected together. As a result, a bolt receiving tube 11 of the first connector housing 37 is superimposed on the frame portion 33 of the second connector housing 31 in coaxial relation thereto. In this case, also, similar effects as described above can be obtained. Those portions, corresponding respectively to those of the preceding embodiment, are designated by identical reference numerals, respectively, and repeated explanation thereof is omitted here.

Figure 13:
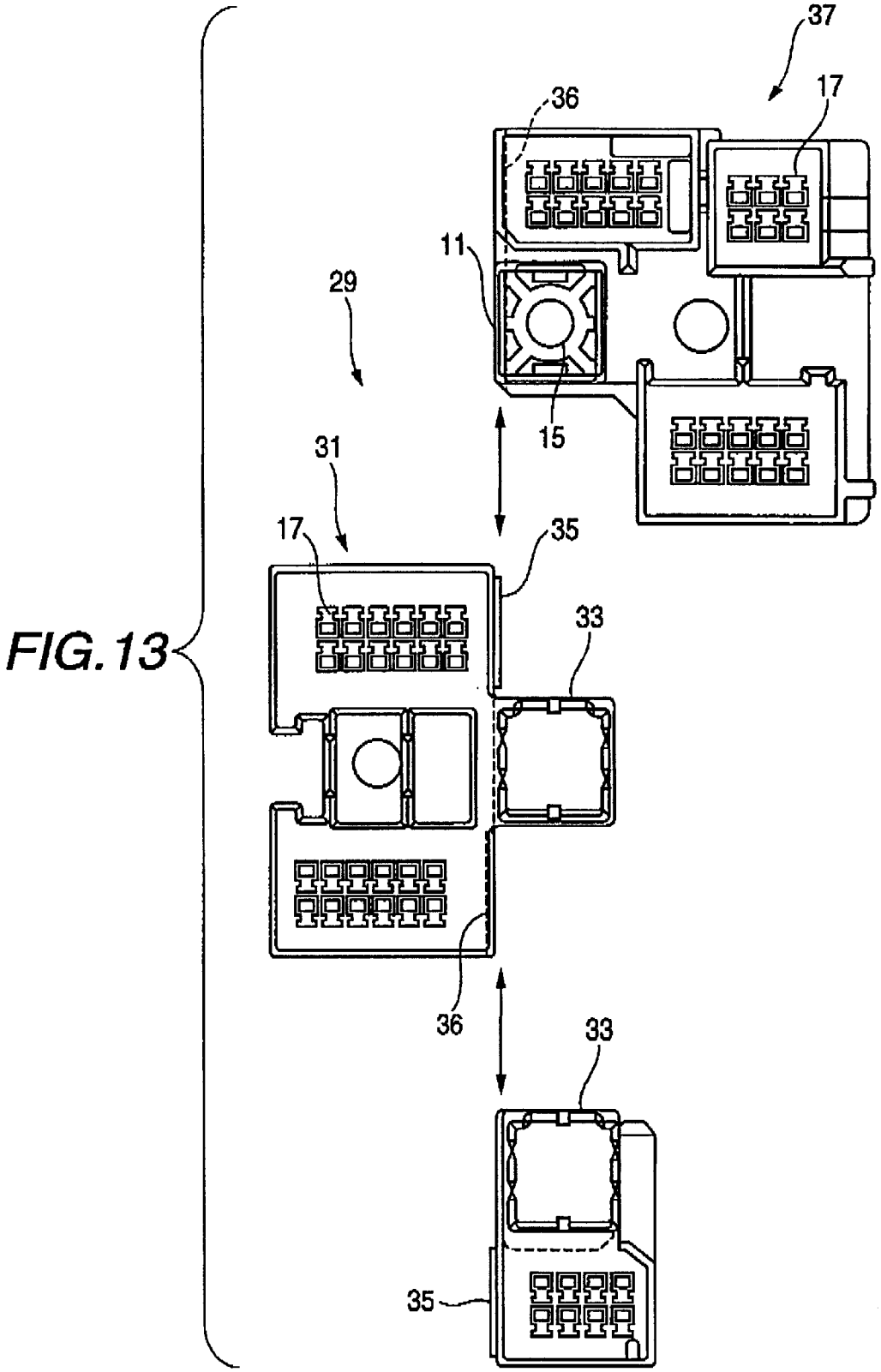
FIG. 13 is a front elevational view of a non-limiting embodiment of the present invention.

In the above embodiments of the invention, although the second connector housing 5, 31 is combined with the first connector housing 3, 37 of the multi-pole connector 1, 29, two or more other connector housings (second connector housing) can be combined with the first connector housing 3, 37. In this case, a frame portion is formed on each of the two or more other connector housings, and all of these frames are superimposed on the bolt receiving tube of the first connector housing in coaxial relation thereto (as shown in FIG. 13).

As described above, in the multi-pole connector-assembling method of the invention and the multi-pole connector of the invention, the fitting of the multi-pole connector relative to the mating multi-pole connector can be effected simultaneously with the alignment of the first connector housing relative to the second connector housing. And besides, similarly with the alignment of the first connector housing, the alignment of the second connector housing can be effected through the bolt, using the nut as a reference, and therefore the accumulation of errors is prevented, and the error can be kept to a minimum.

What is claimed is:

1. A multi-pole connector comprising:

a first connector housing including a bolt and a bolt receiving tube; and a second connector housing including a frame portion, in which the frame portion projects towards the first connector housing from a central portion of a side surface of the second connector housing, wherein the first and second connector housings are connected together so as to coaxially superimpose the frame portion on the bolt receiving tube so that a bolt guide formed on a mating multi-pole connector for connection to the multi-pole connector can be inserted into the frame portion and the bolt receiving tube.

2. The multi-pole connector according to claim 1, wherein the first connector housing and the second connector housing have a connecting mechanism for connecting the first connector housing to the second connector housing before the bolt guide is inserted into the frame portion and the bolt receiving tube.

3. The multi-pole connector according to claim 2, further comprising a plurality of guide rails formed on a side surface, above the frame portion, of the second connector housing for connection to the first connector housing.

4. The multi-pole connector according to claim 3, further comprising a plurality rail grooves provided on a side surface, above the bolt receiving chamber, of the first connector housing, wherein the plurality of guide rails are slidably connected to the plurality of rail grooves to connect the first connector housing with the second connector housing.

5. The multi-pole connector according to claim 2, further comprising a fitting recess portion is provided at an upper and lower surface of the first connector housing.

6. The multi-pole connector according to claim 5, further comprising an engagement portion for being engaged with the second connector housing is formed at a central portion of the fitting recess provided at the upper and lower surface of the first connector housing.

7. A multi-pole connector comprising:

a first connector housing including a bolt and a bolt receiving tube; and a second connector housing including a frame portion, wherein the first and second connector housings are connected together so as to coaxially superimpose the frame portion on the bolt receiving tube so that a bolt guide formed on a mating multi-pole connector for connection to the multi-pole connector can be inserted into the frame portion and the bolt receiving tube, and wherein a plurality of the second connector housings are connected to the first connector housing, and a frame portion of each of the plurality of the second connector housings is coaxially superimposed on the bolt receiving tube.

8. A method of assembling a multi-pole connector comprising a first connector housing including a bolt and a bolt receiving tube, and a second connector housing including a frame portion, the method comprising the steps of:

connecting the first connector housing to the second connector housing so as to coaxially superimpose the frame portion, which projects towards the first connector housing, from a central portion of a side surface of the second connector housing, on the bolt receiving tube; and inserting a bolt guide formed on a mating multi-pole connector for connection to the multi-pole connector into the frame portion and the bolt receiving tube.

* * * * *